US007429554B2

(12) United States Patent
Tipton et al.

(10) Patent No.: US 7,429,554 B2
(45) Date of Patent: Sep. 30, 2008

(54) AUTOMATIC TRANSMISSION FLUIDS WITH PHTHALIC ACID CORROSION INHIBITOR

(75) Inventors: Craig D. Tipton, Perry, OH (US); Bill A. Waters, Painesville, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 443 days.

(21) Appl. No.: 10/752,894

(22) Filed: Jan. 7, 2004

(65) Prior Publication Data

US 2005/0148476 A1 Jul. 7, 2005

(51) Int. Cl.
*C10M 141/10* (2006.01)
*C10M 133/56* (2006.01)
*C07C 55/02* (2006.01)

(52) U.S. Cl. ..... 508/162; 508/506; 508/291

(58) Field of Classification Search ..... 508/162, 508/291, 506
See application file for complete search history.

(56) References Cited

U.S. PATENT DOCUMENTS 2,809,160 A 10/1957 Steward et al.
2,900,339 A 8/1959 Lowe
3,558,490 A 1/1971 Lowe
3,692,681 A 9/1972 Liston et al.
3,974,081 A * 8/1976 Rutkowski et al. ..... 252/79
3,992,307 A * 11/1976 Hotten ..... 508/334
4,088,587 A * 5/1978 Lowe ..... 508/283
4,522,734 A * 6/1985 Horodysky et al. ..... 508/185
4,629,579 A 12/1986 Jessup et al.
4,801,729 A 1/1989 Holstedt et al.
4,857,214 A 8/1989 Papay et al.
5,320,765 A * 6/1994 Fetterman et al. ..... 508/192
5,652,201 A * 7/1997 Papay et al. ..... 508/228
6,127,325 A * 10/2000 Suyama et al. ..... 508/465
6,153,118 A * 11/2000 Hasegawa et al. ..... 252/68

FOREIGN PATENT DOCUMENTS

WO WO 0216533 A2 * 2/2002

* cited by examiner

*Primary Examiner*—Glenn Caldarola
*Assistant Examiner*—Jim Goloboy
(74) *Attorney, Agent, or Firm*—David M. Shold; Christopher D. Hilker

(57) ABSTRACT

A phthalic acid such as terephthalic acid is made soluble in an oil of lubricating viscosity by first mixing it with at least one phosphorus compound. The resulting product is useful for reducing corrosion in a transmission lubricant.

22 Claims, No Drawings

AUTOMATIC TRANSMISSION FLUIDS WITH PHTHALIC ACID CORROSION INHIBITOR

BACKGROUND OF THE INVENTION

The present invention relates to transmission fluids, especially automatic transmission fluids, which contain a phthalic acid to improve the corrosions performance thereof. It also relates to a method for providing phthalic acids, especially terephthalic acid, in a soluble form suitable for such use.

In recent years, particularly in Europe, corrosion of copper alloys by automatic transmission fluid has become a subject of increasing concern. This is due in part to the introduction of electrical components and controls which may be affected by otherwise minor corrosion of wires, contacts, and the like. Bushing wear and the possibility of catalysis of transmission fluid oxidation, due to the presence of leached metals, are also of concern. To address these problems, various anticorrosion approaches and materials are known.

U.S. Pat. No. 4,801,729, Holstedt et al., Jan. 31, 1989, discloses lubricating compositions containing a boron-containing heterocyclic compound, as well as anti-wear and friction-reducing compounds, corrosion inhibitors and oxidation inhibitors. A small amount of terephthalic acid is effective as a lead corrosion inhibitor in the composition. Additional components can include antiwear additives such as zinc dithiophosphate, triphenyl phosphorothionate, etc. Automatic transmission fluids are disclosed.

U.S. Pat. No. 4,629,579, Jessup et al., Dec. 16, 1986, discloses boron derivatives used in lubricating oils. Terephthalic acid is included in a lubricant composition as a corrosion inhibitor.

U.S. Pat. No. 3,692,681 discloses a dispersion of terephthalic acid in a hydrocarbon oil medium which contains highly hindered acylated alkylene polyamines, that is, a highly hindered basic amine containing ashless detergent. The terephthalic acid is dissolved in an auxiliary solvent (a tertiary alkanol or DMSO) and the solution mixed with a hydrocarbon oil solution of the ashless detergent and the auxiliary solvent separated by vaporization or other convenient means.

U.S. Pat. No. 2,900,339, Lowe, Aug. 18, 1959, discloses a process for preparing lubricant compositions and concentrates. Stable dispersions of phthalic acids in oils can be prepared by reacting a phthalic acid with a tertiary amine, combining the reaction mixture thus obtained with an oil of lubricating viscosity, and heating the combined oil and reaction mixture to liberate the tertiary amine.

U.S. Pat. No. 2,809,160, Steward et al., Oct. 8, 1957, discloses a lubricating oil composition having improved corrosion inhibiting properties by using a phthalic acid (isophthalic acid or terephthalic acid). A lubricating oil detergent additive is present in a minor amount, sufficient to suspend the phthalic acid in the oil.

Phthalic acids, and in particular terephthalic acid, although known as a corrosion inhibitor, are generally insoluble or difficultly soluble in oil media. The present invention, therefore, solves the problems of providing phthalic acids in a soluble form in lubricant media, and using the resulting compositions to impart corrosion resistance especially to automatic transmission fluids.

SUMMARY OF THE INVENTION

The present invention provides a composition useful for lubricant applications, comprising:

(a) a phthalic acid or anhydride, ester, or salt thereof;

(b) least one of (i) an inorganic phosphorus acid or salt thereof and (ii) an aliphatic phosphorus ester other than a zinc dialkyldithiophosphate;

(c) a dispersant; and (d) an oil of lubricating viscosity.

Alternatively, the invention provides a composition comprising a homogeneous mixture of:

(a) terephthalic acid and (b) both (i) an inorganic phosphorus acid or salt thereof and (ii) a phosphorus ester.

The invention further provides a method for preparing a soluble composition of (a) terephthalic acid in an oil of lubricating viscosity, comprising:

(A) mixing said terephthalic acid with (b) at least one of (i) an inorganic phosphorus acid or salt thereof and (ii) a phosphorus ester, to provide a concentrate; and (B) mixing said concentrate with (d) said oil of lubricating viscosity in the presence of (c) a dispersant.

The invention further provides a method for reducing the corrosive properties of a transmission lubricant which comprises adding thereto the composition as described above, as well as a method for lubricating a transmission comprising supplying thereto said composition.

DETAILED DESCRIPTION OF THE INVENTION

Various preferred features and embodiments will be described below by way of non-limiting illustration.

The present invention, provides, in one embodiment, a composition useful for lubricant applications, comprising: (a) a phthalic acid or anhydride, ester, or salt thereof; (b) least one of (i) an inorganic phosphorus acid or salt thereof and (ii) an aliphatic phosphorus ester other than a zinc dialkyldithiophosphate; (c) a dispersant; and (d) an oil of lubricating viscosity.

The term "phthalic acid" or "a phthalic acid" is commonly used as a general name encompassing ortho-benzenedioic acid (phthalic acid proper), meta-benzenedioic acid (isophthalic acid) and para-benzenedioic acid (terephthalic acid). As used herein, the term "a phthalic acid" is also intended to encompass hydrocarbyl-substituted phthalic acids, in particular, those with short chain hydrocarbyl or alkyl substituents, such as methyl or ethyl. It is believed that the presence of a relatively long chain hydrocarbyl group, that is, those of 8 carbon atoms or more, will improve the inherent solubility of the material such that the improvements provided by the present invention will be less apparent. Among these materials, terephthalic acid, or an ester or salt thereof, are preferred; and terephthalic acid itself is a preferred material.

The phthalic acid component of the present invention can also be an anhydride, ester (including the half ester), or salt of the phthalic acid. Phthalic acid proper, in particular, readily forms the anhydride due to the geometrical proximity of the acid groups. Any of the phthalic acids can form esters, including esters of $C_1$ to $C_{12}$ alcohols, including methyl esters, ethyl esters, propyl esters, and butyl esters, by known processes, and many of these are commercially available materials. Dioctyl phthalate, for instance, has long been used as a plasticizer. Likewise, various metal salts or ammonium or amine salts can be used, including salts with long branched chain amines like Primene™ 81R from Rohm and Haas Company, and also with amine-containing dispersants. Metals that can be used to form the salts include alkali metal salts, alkaline earth metal salts, and transition metal salts, such as sodium, potassium, calcium, magnesium, barium, copper, iron, and also aluminum salts, although for ease In providing solubility, the monosodium and monopotassium salts are preferred. Preferably the salt should not be one which is so insoluble or intractable that it interferes with the performance or solubilization of the phthalic acid. Moreover, certain benefits of the present invention are more fully revealed if the ester or salt is not in and of itself already easily soluble in the lubricating oil medium. It is to be understood that many of these species may be interconverted in situ. Thus, the acid forms may interact with metal ions present in the medium, thereby forming metal salts. Likewise, the acid forms may interact with basic nitrogen atoms present in a dispersant to form a sort of amine salt. And esters or other compounds may hydrolyze or otherwise react to provide the acid form. All these eventualities are intended to included by the expression "phthalic acid or anhydride, ester, or salt thereof."

The phthalic acid component (i.e., encompassing also the anhydride, ester, or salt) is present in an amount suitable to reduce the corrosive properties of the resulting composition, particularly with respect to copper and/or lead corrosion. When present in a fully formulated lubricating composition, the amount of the phthalic acid component can usefully comprise 0.0001 to 0.1 percent by weight, alternatively, 0.001 to 0.05 percent or 0.0025 to 0.0125 percent. When present in a concentrate, the amount can be proportionately larger, e.g., larger by a factor of approximately 10.

Other components of the present invention include an inorganic phosphorus acid or salt thereof, or an aliphatic phosphorus ester other than a zinc dialkyldithiophosphate. In one embodiment both of these phosphorus-containing components will be present.

Inorganic phosphorus acids include phosphorus compounds which contain one or more oxygen atoms and/or sulfur atoms as its constituent elements, and are typically a phosphorus acid or anhydride. This component thus includes the following materials: phosphorous acid, phosphoric acid, hypophosphoric acid, polyphosphoric acid, phosphorus trioxide, phosphorus tetroxide, phosphorous pentoxide ($P_2O_5$), phosphorotetrathionic acid ($H_3PS_4$), phosphoromonothionic acid ($H_3PO_3S$), phosphorodithionic acid ($H_3PO_2S_2$), phosphorotrithionic acid ($H_3PO_2S_3$), and $P_2S_5$. Among these, phosphorous acid and phosphoric acid and their anhydrides are preferred. A salt of a metal or nitrogen compound, as described above, such as an amine salt of an inorganic phosphorus acid can also be used. It is also possible to use a plurality of these inorganic phosphorus compounds together. The inorganic phosphorus acid is preferably phosphoric acid or phosphorous acid or their anhydride. Phosphoric acid can be supplied as 85% phosphoric acid (aqueous).

Aliphatic phosphorus esters include esters of the formula $(R^1X)(R^2X)P(X)_nX_mR^3$ or salts thereof, where each X is independently an oxygen atom or a sulfur atom, n is 0 or 1, m is 0 or 1, m+n is 1 or 2, and $R^1$, $R^2$, and $R^3$ are hydrogen or aliphatic hydrocarbyl groups. At least one of $R^1$, $R^2$, and $R^3$is a an aliphatic hydrocarbyl group, and preferably at least one is hydrogen. This component thus includes phosphite esters, phosphate esters, and thiophosphite and thiophosphate esters. The esters can be mono-, di- or tri-hydrocarbyl esters. It is noted that certain of these materials can exist in tautomeric forms, and that all such tautomers are intended to be encompassed by the above formula and included within the present invention. For example certain phosphite esters can be written in at least two ways, $(RO)_2$—PH(═O) and $(RO)_2$—P—OH, differing merely by the placement of the hydrogen. Each of these structures are intended to be encompassed by the present invention.

The total number of carbon atoms in $R^1$, $R^2$ and $R^3$ in each of the above formula should be sufficient to render the compound soluble in the medium. Generally, the total number of carbon atoms in $R^1$, $R^2$ and $R^3$ is at least 8, and in some embodiments at least 12 or at least 16. There is no limit to the total number of carbon atoms in $R^1$, $R^2$ and $R^3$ that is required, but a practical upper limit is 400 or 500 carbon atoms. In one embodiment, $R^1$, $R^2$ and $R^3$ in the above formula are independently aliphatic hydrocarbyl groups of preferably 1 to 100, or 1 to 50, or 1 to 30 carbon atoms. Each $R^1$, $R^2$ and $R^3$ can be the same as the other, although they may be different. Examples of useful $R^1$, $R^2$ and $R^3$ groups include hydrogen, t-butyl, isobutyl, amyl, isooctyl, decyl, dodecyl, oleyl, $C_{18}$ alkyl, eicosyl, 2-pentenyl, and dodecenyl.

It is preferred that at least two of the X atoms in the above structure are oxygen, so that the structure will be $(R^1O)(R^2O)P(X)_nX_mR^3$, and more preferably $(R^1O)(R^2O)P(X)_nX_mH$.

The $R^1$ and $R^2$ groups can comprise a mixture of hydrocarbyl groups derived from commercial alcohols. Examples of some preferred monohydric alcohols and alcohol mixtures include the commercially available Alfol™ alcohols marketed by Continental Oil Corporation. Alfol™ 810, for instance, is a mixture containing alcohols consisting essentially of straight-chain primary alcohols having from 8 to 10 carbon atoms. Another commercially available alcohol mixture is Adol™ 60 which comprises about 75% by weight of a straight-chain $C_{22}$ primary alcohol, about 15% of a $C_{20}$ primary alcohol, and about 8% of $C_{18}$ and $C_{24}$ alcohols. The Adol™ alcohols are marketed by Ashland Chemical. A variety of mixtures of monohydric fatty alcohols derived from naturally occurring triglycerides and ranging in chain length from $C_8$ to $C_{18}$ are available from Procter & Gamble Company. Another group of commercially available mixtures include the Neodol™ products available from Shell Chemical Co. Other alcohols which can be used are lower molecular weight alcohols such as methanol, ethanol, propanol, isopropanol, normal butanol, isobutanol, tert-butanol, the pentanols, hexanols, heptanols, octanols (including 2-ethyl hexanol), nonanols, decanols, and mixtures thereof.

The dihydrocarbyl hydrogen phosphites, such as n-dibutyl hydrogen phosphite, useful in this invention can be prepared by techniques well known in the art, and many such phosphites are available commercially.

The total amount of the inorganic phosphorus acid and phosphorus ester, when present in a lubricating formulation is 0.005 percent by weight to 2.0 percent by weight, or, in other embodiments, 0.01 to 1 percent or 0.03 to 0.5 percent by weight. In a concentrate, the amount of these phosphorus compounds can be proportionally higher, e.g., by a factor of 10. If both an inorganic phosphorus acid and phosphorus ester are present, they will preferably be present in weight ratios of 0.01 to 1:1 (acid:ester), or 0.05 to 0.3:1, or 0.1 to 0.15:1. The weight ratio of the phthalic acid (or anhydride, ester or salt) to the total of the inorganic phosphorus acid (or salt) and the aliphatic phosphorus ester is typically 0.005:1 to 0.5:1, and in other embodiments 0.01:1 to 0.1:1 or 0.02:1 to 0.05:1.

In certain embodiments of the present invention, there is also included within the lubricant a dispersant. Dispersants are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include N-substituted long chain alkenyl succinimides, having a variety of chemical structures including typically

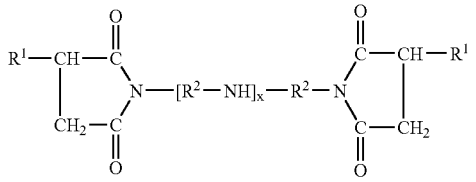

where each $R^1$ is independently an alkyl group, frequently a polyisobutyl group with a molecular weight of 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435 and 3,172,892. Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022. Yet another class of ashless dispersant is Mannich bases. These are materials which are formed by the condensation of a higher molecular weight, alkyl substituted phenol, an alkylene polyamine, and an aldehyde such as formaldehyde. Mannich dispersants are described in more detail in U.S. Pat. No. 3,634,515. Other dispersants include polymeric dispersant additives, which are generally hydrocarbon-based polymers which contain polar functionality to impart dispersancy characteristics to the polymer. These and other dispersants are described in greater detail in PCT Publication WO03/095595.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of dispersant in the lubricant formulations of the present invention can be 1.2 to 4.8 percent by weight, and in other embodiments 2 to 4 percent or 2.2 to 3 percent by weight. In a concentrate, the amount of dispersant can be increased by a proportional amount, e.g., by a factor of 10.

Another component of the lubricants of the present invention is an oil of lubricating viscosity. These oils can be selected from any of the base oils in Groups I-V as specified in the American Petroleum Institute (API) Base Oil Interchangeability Guidelines. The base oil groups are as follows:

| Base Oil Category | Sulfur (%) | | Saturates(%) | Viscosity Index |
|---|---|---|---|---|
| Group I | >0.03 | and/or | <90 | 80 to 120 |
| Group II | <0.03 | and | >90 | 80 to 120 |
| Group III | <0.03 | and | >90 | >120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful, regardless of the process used to make them. Synthetic lubricating oils include hydrocarbon oils and halo-substituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from $C_5$ to $C_{12}$ mono-carboxylic acids and polyols or polyol ethers. Other synthetic lubricating oils include liquid esters of phosphorus-containing acids, polymeric tetrahydrofurans, silicon-based oils such as the poly-alkyl-, polyaryl-, polyalkoxy-, or polyaryloxy-siloxane oils, and silicate oils. Hydrotreated naphthenic oils are also known and can be used, as well as oils prepared by a Fischer-Tropsch gas-to-liquid synthetic procedure. Unrefined, refined and rerefined oils, either natural or synthetic (as well as mixtures of two or more of any of these) of the type disclosed hereinabove can used in the compositions of the present invention. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The oil of lubricating viscosity can be present in an amount suitable to provide a fully formulated lubricant, e.g., Thus it will normally be at least 50% by weight of the composition, preferably 83 to 98%, and more preferably 88 to 95%. Alternatively, it can be present in an amount suitable to provide an oil-containing concentrate, e.g., up to 50% by weight, or up to 30 or 20% by weight, or even 1 to 10% by weight. In all instances, any diluent oil in which the other components is conventionally supplied is to be counted toward the amount of the oil of lubricating viscosity.

Other materials which are commonly present in a lubricant, especially a lubricant for an automatic transmission, can be present. These include viscosity modifiers, including dispersant viscosity modifiers; antioxidants; anti-foam agents; seal swell agents; dyes; detergents; and friction modifiers. These and various other components which can be used in the present invention are described in greater detail in PCT Patent Application WO 00/70001.

Detergents are well-known materials in the lubricating art. They are typically overbased materials, otherwise referred to as overbased or superbased salts, and are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (mineral oil, naphtha, toluene, xylene, etc.) for said acidic organic material, a stoichiometric excess of a metal base, and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. Patents describing techniques for making basic salts of sulfonic acids, carboxylic acids, phenols, phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Friction modifiers are well known to those skilled in the art. A useful list of friction modifiers is included in U.S. Pat. No. 4,792,410. U.S. Pat. No. 5,110,488 discloses metal salts of fatty acids and especially zinc salts, useful as friction modifiers. Friction modifiers also include fatty phosphites, fatty acid amides, fatty epoxides, borated fatty epoxides, fatty amines, glycerol esters, borated glycerol esters, alkoxylated fatty amines, borated alkoxylated fatty amines, metal salts of fatty acids, sulfurized olefins, fatty imidazolines, condensation products of carboxylic acids and polyalkylene-polyamines, metal salts of alkyl salicylate, amine salts of alkylphosphoric acids, and mixtures thereof. These materials are described in greater detail in Copending PCT Application US03/22000, filed 11 Jul., 2003, designating the US and claiming priority from U.S. provisional application 60/395,374, filed 12 Jul., 2002

One particularly suitable class of friction modifiers is the borate ester friction modifiers, which includes borate epoxides and borated carboxylic esters of such materials as glyercol. Borated epoxides are known from Canadian Patent No. 1,188,704. These oil-soluble boron-containing compositions can be prepared by reacting, at a temperature from 80° C. to 250° C., boric acid or boron trioxide with at least one epoxide having the formula

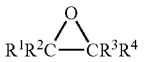

wherein each of $R^1$, $R^2$, $R^3$ and $R^4$ is hydrogen or an aliphatic radical, or any two thereof together with the epoxy carbon atom or atoms to which they are attached, form a cyclic radical. The epoxide preferably contains at least 8 carbon atoms. The borated fatty epoxides can be characterized by the method for their preparation which involves the reaction of two materials. Reagent A can be boron trioxide or any of the various forms of boric acid including metaboric acid ($HBO_2$), orthoboric acid ($H_3BO_3$) and tetraboric acid ($H_2B_4O_7$). Boric acid, and especially orthoboric acid, is preferred. Reagent B can be at least one fatty epoxide having the above formula. In the formula, each of the R groups is most often hydrogen or an aliphatic radical with at least one being a hydrocarbyl or aliphatic radical containing at least 6 carbon atoms. The molar ratio of reagent A to reagent B is generally 1:0.25 to 1:4. Ratios of 1:1 to 1:3 are preferred, with about 1:2 being an especially preferred ratio. The borated fatty epoxides can be prepared by merely blending the two reagents and heating them at temperature of 80° to 250° C., preferably 100° to 200° C., for a period of time sufficient for reaction to take place. If desired, the reaction may be effected in the presence of a substantially inert, normally liquid organic diluent. During the reaction, water is evolved and may be removed by distillation.

Borated fatty acid esters of glycerol can be prepared by borating a fatty acid ester of glycerol with boric acid with removal of the water of reaction. Preferably, there is sufficient boron present such that each boron will react with from 1.5 to 2.5 hydroxyl groups present in the reaction mixture. The reaction may be carried out at a temperature in the range of 60° C. to 135° C., in the absence or presence of any suitable organic solvent.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

The soluble compositions of terephthalic acid of the present invention can be prepared by mixing the terephthalic acid with either or preferably both of the two phosphorus-containing components described above, that is, the inorganic phosphorus acid and the phosphorus ester. The mixture obtained thereby, a concentrate, can be then further mixed with an oil of lubricating viscosity in the presence of a dispersant. It is not necessary that the terephthalic acid be pre-reacted with the dispersant prior to mixing with the other components (the phosphorus compounds and/or the oil) and in fact, for simplicity and economy of operation, it is preferred that no such pre-reaction be conducted.

The terephthalic acid (a) will typically be combined with (b) the combination of inorganic phosphorus acid or salt and the phosphorus ester in a weight ratio (a):(b) of 0.005:1 to 0.5:1. Other suitable ranges include 0.01:1 to 0.1:1 and 0.02:1 to 0.05:1, as mentioned above. The relative amounts of the inorganic phosphorus acid or salt and the phosphorus ester, if both are present, will typically be in the ratios 0.01 to 1:1 (acid:ester) or in other ratios as mentioned above. The mixing to form the concentrate will typically be conducted at room temperature or elevated temperatures, e.g., 25° C. to 150° C., or 60° C. to 140° C., or 80° C. to 130° C. for an appropriate length of time to assure complete homogeneous mixing, e.g., at least 1 minute, such as 1 minute to 6 hours or 5 minutes to 1 hour. It will be understood that mixing may often be achieved more rapidly at higher temperatures, and the selection of appropriate parameters is within the abilities of the person skilled in the art. The mixing and solubilization can be conducted in two stages, a first at 60-80° C. and a second at 100-140° C. In one embodiment, terephthalic acid is mixed with the phosphorus ester, without an inorganic phosphorus acid or salt, and heated to, e.g., above 100° C. until the terephthalic acid is dissolved, followed by cooling to, e.g., below 100° C., to form a terephthalic acid-containing concentrate or mixture. Thereafter the inorganic phosphorus acid or salt can be added to the mixture, or the mixture can be directly combined with other components to prepare a subsequent concentrate or a fully formulated lubricant. The mixing of the mixture or concentrate (with or without the inorganic phosphorus acid or salt or other components) with an oil of lubricating viscosity and a dispersant, which may be added in either order or simultaneously, will typically be at a combination of similar times and temperatures as set forth for the preparation of the mixture or concentrate itself; customary temperatures of 60-80° C. can be used.

Other components as described above (additional dispersants, detergents, friction modifiers) can be incorporated into the mixture at the time of original mixing of the concentrate with the oil of lubricating viscosity, or they can be added later. Moreover, the initial mixture of the (first) concentrate with the oil of lubricating viscosity may itself provide a (second, oil-containing) concentrate which may be later combined with additional components and oils to form a complete lubricant formulation. In general, the solubilized terephthalic acid can be said to be added to the lubricant formulation, in order to reduce the corrosive properties thereof.

The products of the present invention are typically used in or as a transmission fluid, particularly for an automatic transmission, and will serve to reduce the otherwise corrosive properties of the fluid, leading to reduced corrosion of metal parts in the transmission. The transmission fluids containing the solubilized terephthalic acid of the present invention are supplied to the transmissions in a conventional manner.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

- hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);
- substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);
- hetero substituents, that is, substituents which, while having a predomimantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

EXAMPLES

Example 1

Dibutyl hydrogen phosphite, 3.5 g, and 85% phosphoric acid, 1.75 g (aqueous) are mixed at room temperature and then heated to 70° C. To the mixture is added 0.21 g of terephthalic acid, and the mixing is continued at 70-75° C. for about 10 minutes and then the temperature is slowly raised to about 130° C. until the solid terephthalic acid is dissolved.

Example 2

Dibutyl hydrogen phosphite, 3.5 g, and terephthalic acid, 0.12 g, are mixed at room temperature and then gradually heated to about 130° C. until the solid terephthalic acid is dissolved. The mixture is then cooled to about 70° C., and then 85% phosphoric acid, 1.75 g (aqueous), is added and the mixing continued at 70° C. for about 10 minutes.

Example 3

Dibutyl hydrogen phosphite, 3.5 g, and terephthalic acid, 0.12 g, are mixed at room temperature and then gradually heated to about 130° C. until the solid terephthalic acid is dissolved. The mixture is then cooled to about 70° C., remaining clear, and is used for further blending with other components (e.g, an inorganic phosphorus acid or salt) to prepare an additive concentrate.

Examples 4-7

Fully formulated automatic transmission fluid compositions are prepared containing varying amounts of terephthalic acid and phosphorus components, generally as prepared in Examples 1-3. (Example 4 is a comparative examples which does not contain the terephthalic acid.) Each formulation is subjected to an L38 copper/lead coupon corrosion test, in which a cleaned copper/lead bearing is subjected to 30 mL test fluid at 150° C. for 120 hours. Bearing weight loss and Cu and Pb content in the test fluid are measured. The formulations, expressed as percent by weight, and results are presented in Table I, below.

TABLE I

| Composition | Ex. 4 (compar.) | Ex. 5 | Ex. 6 | Ex. 7 |
|---|---|---|---|---|
| Terephthalic acid | 0 | 0.0050 | 0.0075 | 0.0100 |
| Dibutyl hydrogen phosphite | 0.20 | 0.20 | 0.20 | 0.20 |
| 85% Phosphoric acid | 0.030 | 0.030 | 0.030 | 0.030 |
| Succinimide dispersants, borated + non-borated, incl. ca. 42% oil | 4.68 | 4.68 | 4.68 | 4.68 |
| Calcium overbased detergents, including ca. 50% oil | 1.02 | 1.02 | 1.02 | 1.02 |
| Antioxidants | 0.90 | 0.90 | 0.90 | 0.90 |
| Seal swell agent | 0.80 | 0.80 | 0.80 | 0.80 |
| Friction modifier | 0.20 | 0.20 | 0.20 | 0.20 |
| Ethoxylated amine | 0.10 | 0.10 | 0.10 | 0.10 |
| Thiadiazole (additional anticorrosion agent) | 0.03 | 0.03 | 0.03 | 0.03 |
| Minor components | 0.06 | 0.06 | 0.06 | 0.06 |
| Viscosity modifiers, including ca. 28% oil | 3.90 | 3.90 | 3.90 | 3.90 |

TABLE I-continued

| Composition | Ex. 4 (compar.) | Ex. 5 | Ex. 6 | Ex. 7 |
|---|---|---|---|---|
| Base oil: blend of 59% mineral oil + 41% polyalphaolefin, 4 cSt | 87.9 | 87.9 | 87.9 | 87.9 |
| additional diluent oil | 0.21 | 0.21 | 0.21 | 0.21 |
| Test Results | | | | |
| Copper, % in drain oil | 0.0044 | 0.0023 | 0.0023 | 0.0021 |
| Lead, % in drain oil | 0.0082 | 0.0040 | 0.0037 | 0.0040 |
| Weight loss, mg | 1.8 | 1.1 | 0.5 | 0.7 |

The results show that both copper and lead corrosion are significantly reduced by the inclusion of the phthalic acid of the present invention. The reduction in copper corrosion occurs even though there is already another, conventional, copper corrosion fix present in the composition.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A composition useful for lubricant applications, comprising:

(a) about 0.0001 to about 0.05 percent by weight of terephthalic acid or a salt thereof; and (b) (i) phosphoric acid or phosphorous acid and (ii) a dialkyl hydrogen phosphite; and (c) a dispersant; and (d) an oil of lubricating viscosity;

wherein said composition is prepared by mixing the terephthalic acid or salt thereof with (b)(ii) the dialkyl hydrogen phosphite, without an inorganic phosphorus acid or salt, and thereafter adding (b)(i) the phosphoric acid or phosphorous acid.

2. The composition of claim 1 wherein the terephthalic acid or salt is terephthalic acid.

3. The composition of claim 1 wherein the amount of the terephthalic acid is about 0.001 percent by weight to about 0.05 percent by weight of the composition.

4. The composition of claim 1 wherein the dialkyl hydrogen phosphite is di-n-butyl hydrogen phosphite.

5. The composition of claim 1 wherein the total amount of the dialkyl hydrogen phosphite is about 0.005 percent by weight to about 2.0 percent by weight.

6. The composition of claim 1 wherein the dispersant is a succinimide dispersant.

7. The composition of claim 1 wherein the amount of the dispersant is about 1.2 to about 4.8 percent by weight.

8. The composition of claim 1 wherein (a) the terephthalic acid or salt and (b) the combination of phosphoric acid or phosphorous acid and the dialkyl hydrogen phosphite are present in a weight ratio (a):(b) of about 0.005:1 to about 0.5:1.

9. The composition of claim 1 wherein the amount of the oil of lubricating viscosity is an amount suitable to provide an oil-containing concentrate.

10. The composition of claim 1 wherein the amount of the oil of lubricating viscosity is an amount suitable to provide a fully formulated lubricant.

11. The composition of claim 1 further comprising a detergent.

12. The composition of claim 1 further comprising a borate ester friction modifier.

13. A method for preparing a soluble composition of about 0.0001 to about 0.05 percent by weight of (a) terephthalic acid in an oil of lubricating viscosity, comprising:

mixing said terephthalic acid with (b) (ii) a dialkyl hydrogen phosphite, and thereafter adding (b)(i) phosphoric acid or phosphorous acid (d) said oil of lubricating viscosity, and (c) a dispersant.

14. The method of claim 13 wherein the terephthalic acid is mixed with a dialkyl hydrogen phosphite with heating until the terephthalic acid is dissolved.

15. The method of claim 13 wherein the terephthalic acid is not pre-reacted with a dispersant prior to mixing with the oil of lubricating viscosity (d).

16. The method of claim 13 wherein the terephthalic acid (a) is combined with (b) the phosphoric acid or phosphorous acid and the dialkyl hydrogen phosphite in a weight ratio (a):(b) of about 0.005:1 to about 0.5:1.

17. The method of claim 13, further comprising including in the product thereof at least one detergent, dispersant, or friction modifier.

18. A method for reducing the corrosive properties of a transmission lubricant which comprises adding thereto the composition of claim 1.

19. A method for lubricating a transmission, comprising supplying thereto the composition of claim 1.

20. The composition of claim 1 wherein the mixing of the terephthalic acid or salt with the dialkyl hydrogen phosphite is accompanied by heating at about 60° C. to about 150° C.

21. The method of claim 14 wherein the heating is at about 60° C. to about 159° C.

22. A composition useful for lubricant applications, comprising:

(a) about 0.001 to about 0.05 percent by weight of terephthalic acid or a salt thereof; and (b) about 0.01 to about 1.0 percent by weight of: (i) phosphoric acid or phosphorous acid and (ii) a dialkyl hydrogen phosphite; and (c) a dispersant; and (d) an oil of lubricating viscosity;

wherein said composition is prepared by mixing the terephthalic acid or salt thereof with (b)(ii) the dialkyl hydrogen phosphite without an inorganic phosphorus acid or salt, said mixing accompanied by heating at about 60° C. to about 150° C., and thereafter adding (b)(i) the phosphoric acid or phosphorous acid.

* * * * *